US006053283A

United States Patent [19]

Lingen

[11] Patent Number: 6,053,283

[45] Date of Patent: Apr. 25, 2000

[54] SCAFFOLDING MAST

[76] Inventor: Paul Lingen, Grefratherstr. 42, 47669, Wachtendonk/Wankum, Germany

[21] Appl. No.: 08/664,908

[22] Filed: Jun. 17, 1996

[30] Foreign Application Priority Data

Jun. 23, 1995 [DE] Germany ..... 195 22 526

[51] Int. Cl.[7] ..... E04H 12/00

[52] U.S. Cl. ..... 182/146; 182/141

[58] Field of Search ..... 182/146, 141, 182/82, 179

[56] References Cited

U.S. PATENT DOCUMENTS 4,481,748 11/1984 D'Alessio ..... 182/179 X 5,487,446 1/1996 Patnode ..... 182/146 X

*Primary Examiner*—Alvin C. Chin-Shue

*Attorney, Agent, or Firm*—Watson Cole Grindle Watson, P.L.L.C.

[57] ABSTRACT

A scaffolding mast with at least two profile bars (1, 2, 3) which are attached to the edges of a triangle or square forming the cross section of the scaffolding mast. Two of the profiles (1, 2, 3) are connected to one or two of three connecting plates (10, 17, 18) forming the side of the triangle or square. Two grooves (4–9) are provided on the inner area of each of the profile bars (1, 2, 3) in which 90° offset edges (13, 14) of the connecting plate (10, 17, 18) are inserted and fastened at the place of insertion (FIG. 1).

10 Claims, 6 Drawing Sheets

SCAFFOLDING MAST

BACKGROUND OF THE INVENTION

The invention relates to a scaffolding mast having a triangular or square cross section and including at least two profile bars attached to corners of the triangle or square, the two of the profile bars being connected to one side of the connecting plate triangle.

More commonly known is the light antennae tensioning mast made from three profile bars which are connected together in such a way that their cross-section form an equilateral triangle. The profiles have the same structure. One of these profile bars is made from steel metal. A round, cylindrical strengthening device is attached to one side of this plate. There is a pipe-section on the other side which is open along one side. The cylindrical strengthening device of one profile bar fits into the laterally open pipe-section of the next profile bar. The well-known antennae tensioning mast consists of standardized specially pressed profiles.

The object of this invention is to provide a scaffolding mast as described above wherein the width and/or thickness of the connecting plates be of different dimensions which enables static, individually designed scaffolding masts to be formed.

SUMMARY OF THE INVENTION

This invention achieves this object by providing two grooves on the inner area of each profile bar. The 90° offset edges of the connecting plate are inserted into these grooves and fastened at the place of insertion.

This creates a scaffolding mast which can take different forms, depending on the width and/or thickness of the plate. It is thus possible to create a scaffolding mast for which profile bars can be pressed or rolled specially for the corners and other important connecting lines. These profile bars can also be fitted with additional structures for carrying out other functions: for example guides for rollers, receptacle parts for other mechanical components, etc. Furthermore, it is also possible to pick up plates, if necessary also plates of different thicknesses, which have to be welded by turning the pick up grooves 90° to the plate's direction of pull with relatively little effort. The different widths and/or thicknesses of the plate makes it possible to create static, individually designed carriers or supports.

When two profile bars are positioned wide apart and have to be bridged by a static loaded metal plate, there is normally the danger of the plate bending. This bending effect of the metal plate when two profiles are far apart is counteracted by the plate being designed correspondingly, e.g., it is fitted with edge pieces or beads, or shaped in the form of a shaft profile which runs diagonal to the support axis. When profile bars are positioned wide apart and the support profile only has a small static load, punch holes can be made in the metal plate to reduce the weight.

In the case of the already well-known supports and carriers made from pressed profile bars, the bar form cannot be altered. This means that a chain of pressed profiles always gives a correspondingly structured form. The rigid design of this familiar scaffolding mast cannot be altered and neither can the static units be changed in any way.

In the present invention the profile bars can be made from extruded profiles. It is also possible to have hollow steel or rolled steel section bars, etc. The connecting plates inserted in the grooves can also be welded to the profile bars. These profile bars can either have the same form or have different structures.

Furthermore, it is desirable that the profiles are either all the same or all different.

For proper functioning, a self-driven (self-propelled) slide must be fitted along at least one profile bar lengthwise to the scaffolding mast.

The connecting plates are constructed in accordance with their static loads.

DETAILED DESCRIPTION OF THE PREFERRED EMBODIMENTS

Figure 1:
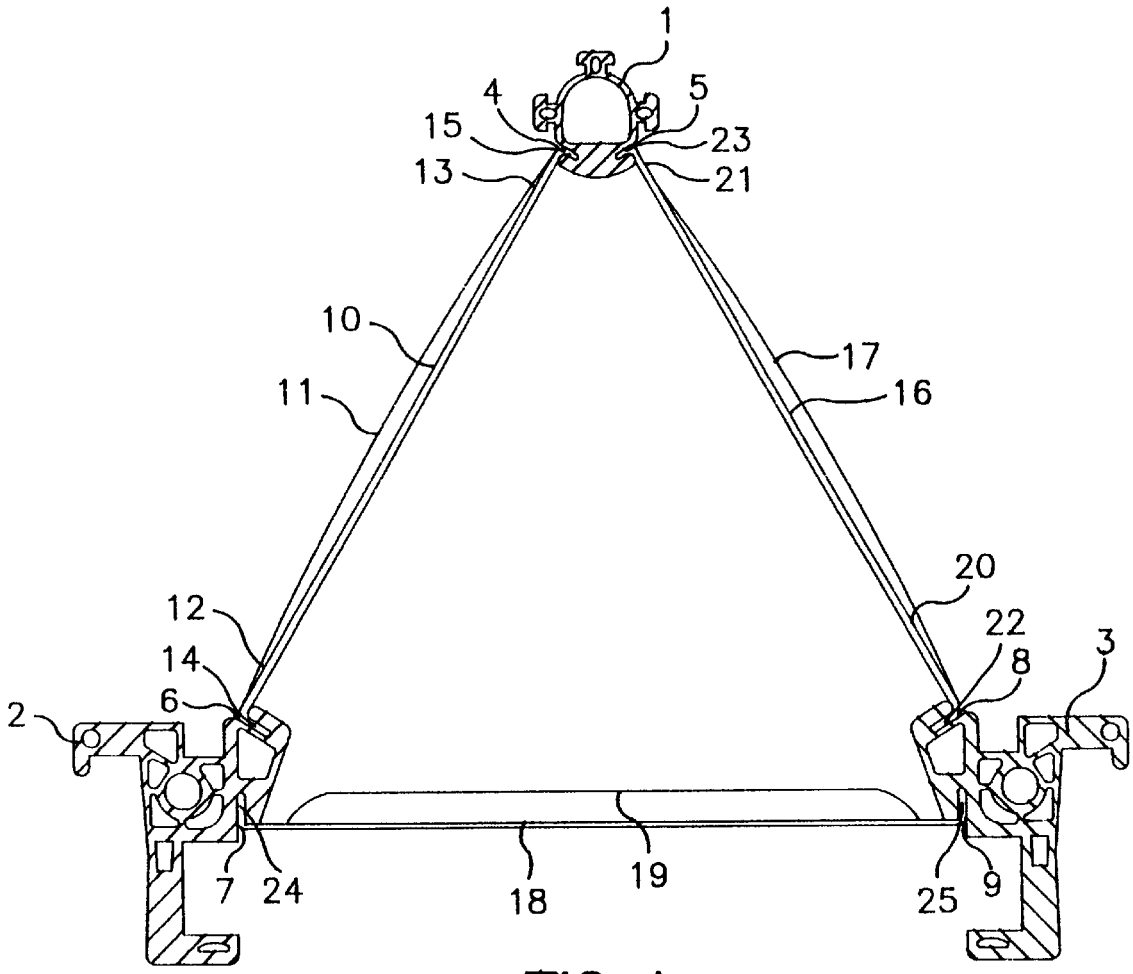
FIG. 1 is a cross sectional view of a scaffolding mast according to one embodiment of the invention having three profile bars at its corners, the positioning of the profile bars causing the cross section to be in the form of an equilateral triangle.

The scaffolding mast shown in FIG. 1 includes three profiles 1,2,3, two of which 2,3 are identical, in FIG. 1 consists of three identical profiles 1, 2, 3 in which there are grooves 4, 5, 6, 7, 8, 9. A connecting plate 10 with a cross connection 11 between profile bars 1 and 2, has a bevelled profile 14, 15 on each end 12, 13. Bevelled profiles 14 and 15 are inserted in grooves 6 and 4. The connecting plate 10 is welded to profile bars 1 and 2 at both bevelled edges 14 and 15. The same that applies for connecting plate 10 also applies for connecting plate 16 with cross connection 17. Connecting plate 18 has a pressed-in shaft profile 19. Connecting plate 16 with cross connection 17 is inserted into grooves 5, 8, of profile bars 1, 3, with bevelled profiles 22, 23, and fastened. Connecting plate 18 is inserted into grooves 7, 9 with bevelled profiles 24, 25, and fastened.

Figure 2:
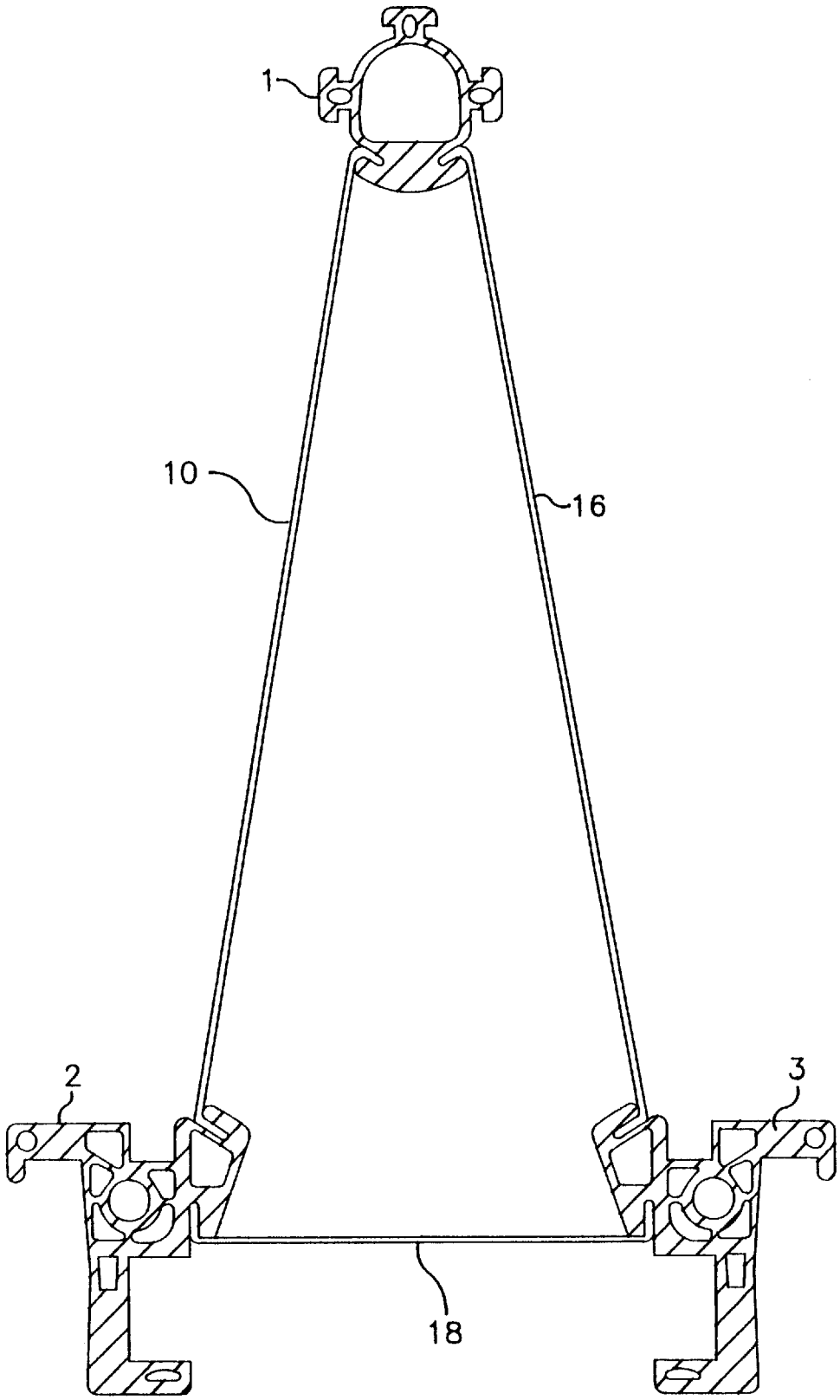
FIG. 2 is a cross sectional view of a scaffolding mast according to another embodiment of the invention having three profile bars at its corners, the positioning of the profile bars causing the cross section to be in the form of an isosceles triangle.
Figure 3:
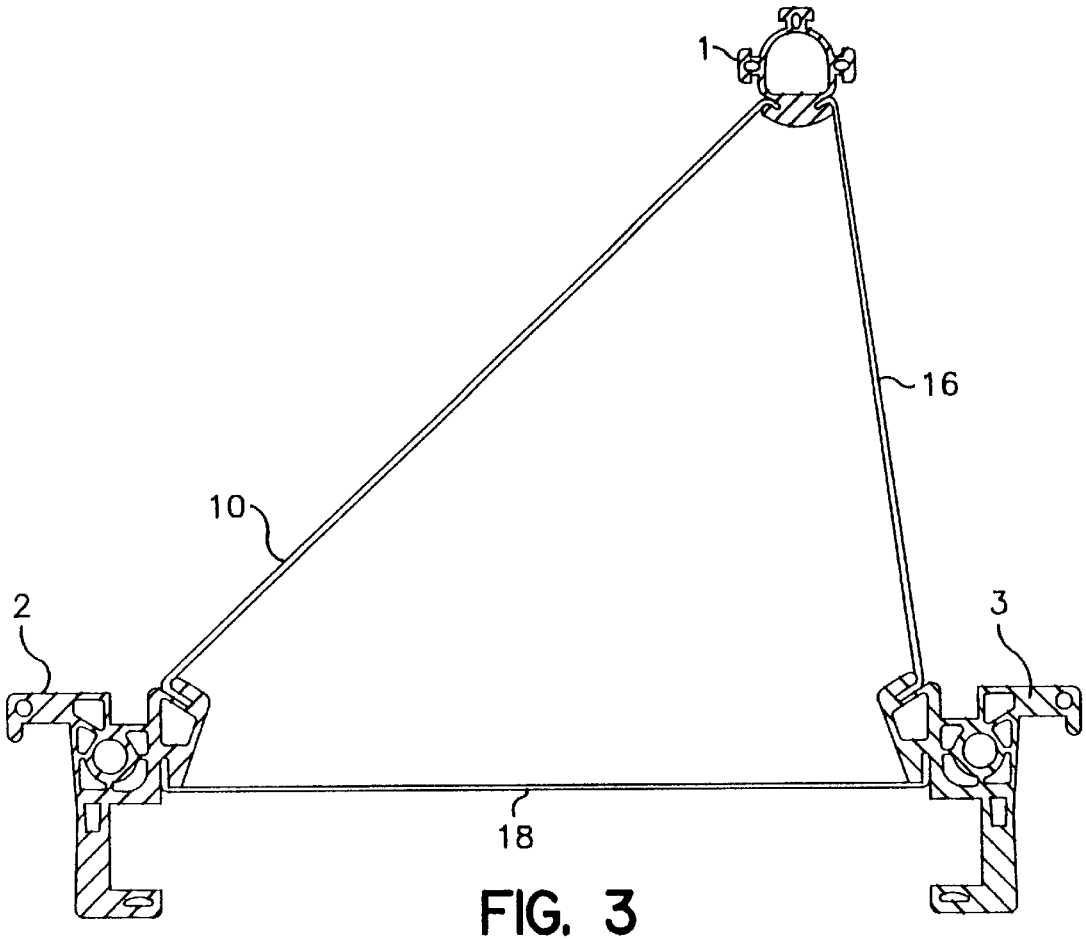
FIG. 3 is a cross section view of a scaffolding mast according to another embodiment of the invention having three profile bars at its corners, the positioning of the profile bars causing the cross section to be in the form of a triangle of any shape.

The scaffolding masts in FIGS. 1, 2 and 3 show that profile bars 1, 2, 3, can be arranged in many ways: To form the edges of an equilateral triangle FIG. 1, to form the edges of an isosceles triangle (FIG. 2), or to form the edges of a triangle with edges of different lengths (FIG. 3).

Figure 4:
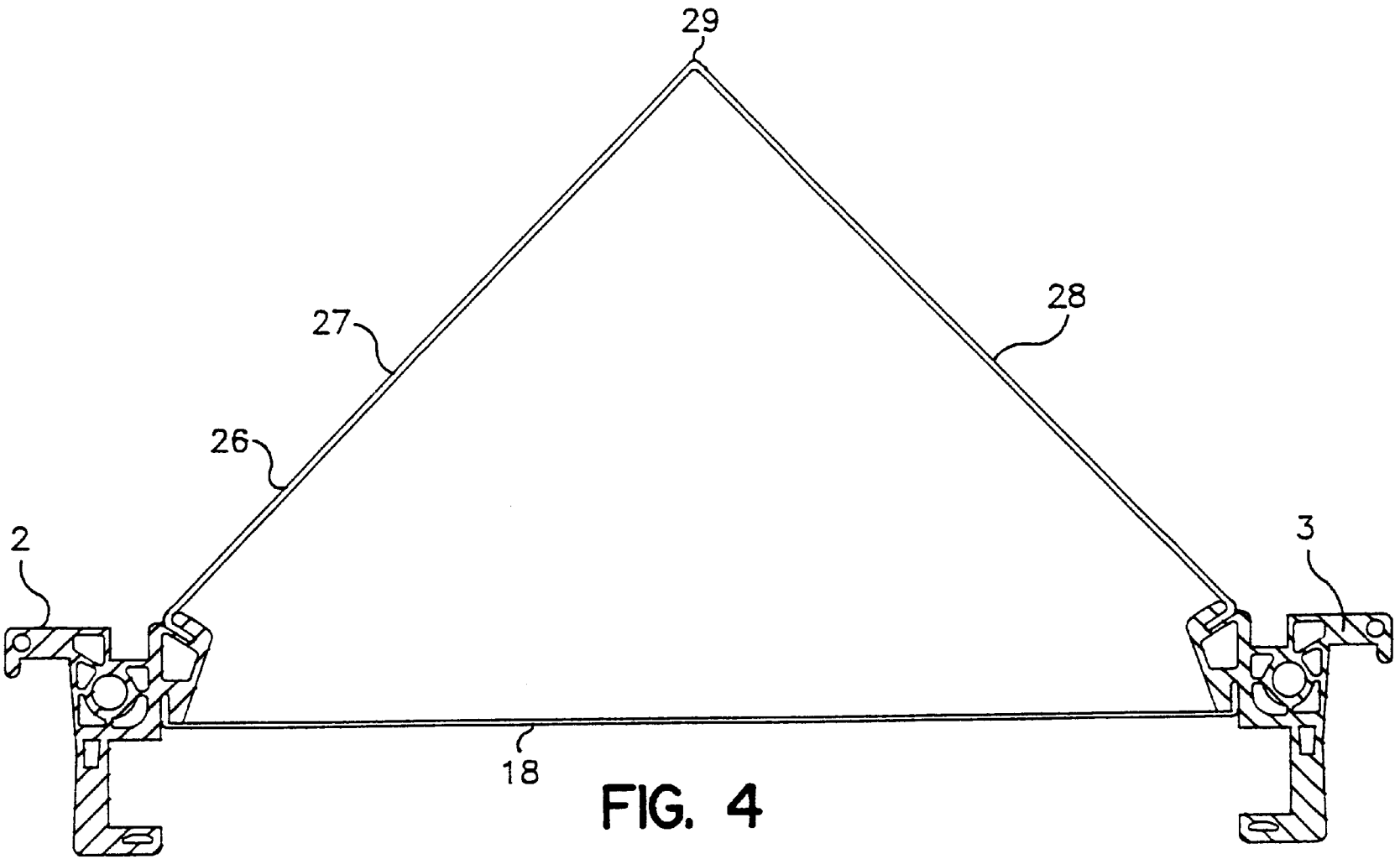
FIG. 4 is a cross section view of a scaffolding mast according to another embodiment of the invention having two profile bars, the two profile bars being connected by a V-shaped connecting plate so as to provide the scaffolding mast with a triangular cross section.

FIG. 4 shows a scaffolding mast with only two profile bars 2, 3. These are connected by means of the connecting plate 8 which runs all the way through. The other connecting plate 26 is made up from the two sides 27 and 28, which form edge 29.

Figure 5:
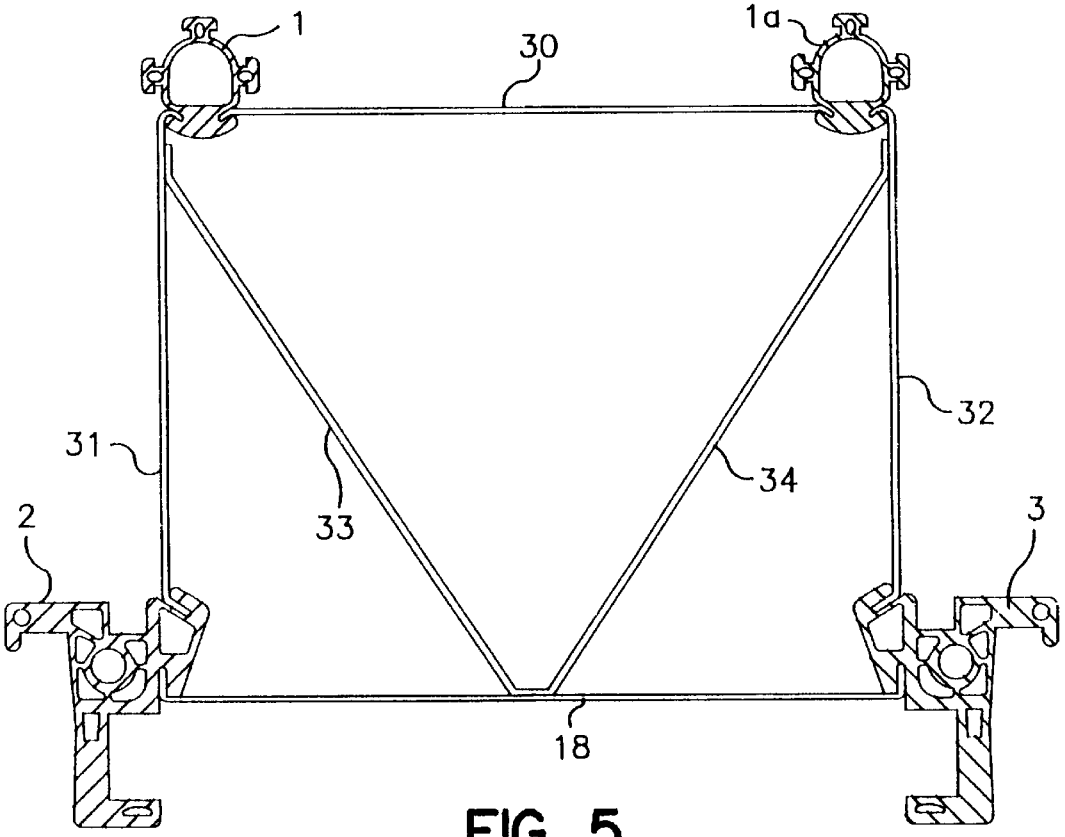
FIG. 5 A cross section through a square scaffolding mast with four profile bars at its corners, such that the cross section is in the form of a square.

The square scaffolding mast illustrated in FIG. 5 has two identical profile bars 1 and 1*a*, which are connected by means of connecting plate 30. There are also two identical profile bars 2 and 3, between which connecting plate 18 is positioned. Connecting plate 31 is positioned between profile bars 1 and 2, and connecting plate 32 is positioned between profile bars 1*a* and 3. Connecting plates 18, 31 and 32 are connected via the reinforcement plates 33 and 34.

Figure 6:
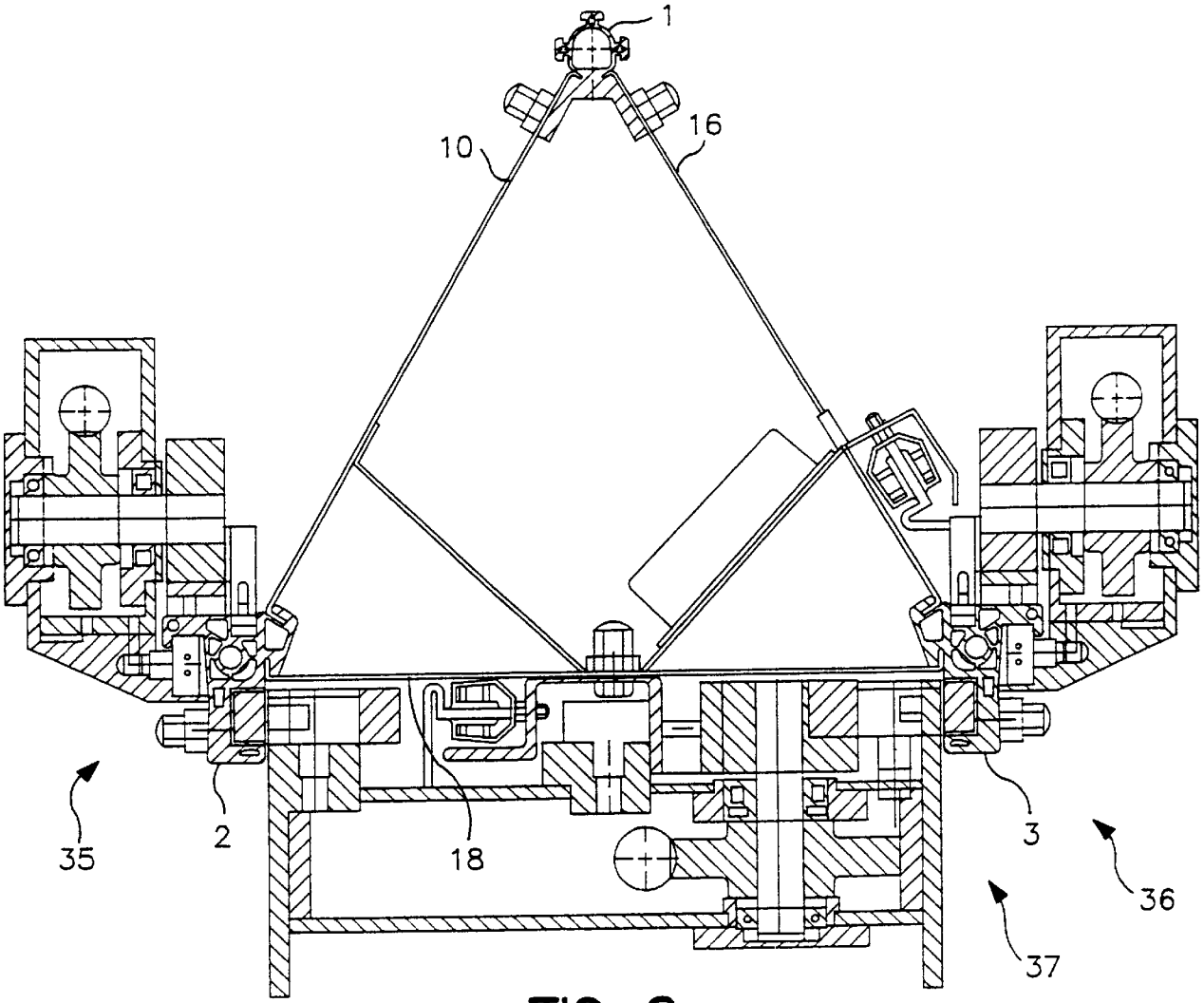
FIG. 6 depicts the scaffolding mast of FIG. 1 with several self-propelled sledges fixed along the scaffolding mast to two profile bars in each case.

FIG. 6 shows a scaffolding mast with two self-propelled slides 35 and 36 fixed to profile bars 2 and 3 lengthwise to the scaffolding mast. There is also another self-propelled slide 37 fixed lengthwise to scaffolding mast 18 between profile bars 2 and 3.

List of Different Structural Parts

1 Profile bar
1*a* Profile bar
2 Profile bar
3 Profile bar
4 Groove
5 Groove
6 Groove
7 Groove
8 Groove
9 Groove
10 Connecting plate
11 Cross connection
12 End
13 End
14 Bevelled profile
15 Bevelled profile
16 Connecting plate
17 Cross connection
18 Connecting plate
19 Shaft profile
20 End
21 End
22 Bevelled profile
23 Bevelled profile
24 Bevelled profile
25 Bevelled profile
26 Connecting plate
27 Side
28 Side
29 Edge
30 Connecting plate
31 Connecting plate
32 Connecting plate
33 Reinforcement plate
34 Reinforcement plate
35 Slide
36 Slide
37 Slide

I claim:

1. A scaffolding mast which comprises first and second identical profile bars located in spaced relation to one another and oriented as mirror images of one another, said first and second profile bars each including first and second grooves; first connecting means connected between said first and second profile bars, said first means comprising a first plate having a center portion and opposite end flanges that extend at about a 90° angle from a plane defined by said center portion and in the same direction relative to said center portion, said opposite end flanges of said first connecting plate extending into corresponding first grooves in said first and second profile bars so as to be connected to said first and second profile bars; and second connecting means connected between said first and second profile bars, said first and second profile bars and said first and second connecting means providing said scaffolding mast with at least a three-sided cross section.

2. A scaffolding mast according to claim 1, wherein said connecting means comprises a second plate which has a V-shaped center portion and opposite end flanges, and wherein said opposite end flanges of said second plate extend within respective second grooves in said first and second profile bars so as to be connected to said first and second profile bars, resulting in said scaffolding mast having a triangular cross section.

3. A scaffolding mast according to claim 2, wherein said opposite end flanges of said V-shaped center portion extend at about a 90° angle relative to adjacent sections of said V-shaped center portion.

4. A scaffolding mast according to claim 1, wherein said second connecting means comprises a third profile bar providing first and second grooves therein, a second plate which has opposite end flanges that respectively extend in a second groove of said first profile bar and in a first groove in said third profile bar, and a third plate which has opposite end flanges that respectively extend in a second groove of said second profile bar and in a second groove of said third profile bar, resulting in said scaffolding mast having a triangular cross section.

5. A scaffolding mast according to claim 4, wherein said opposite end flanges of said second plate and said opposite end flanges of said second plate and said opposite end flanges of said third plate extend at about a 90° angle relative to respective center portions of said plates.

6. A scaffolding mast according to claim 1, wherein said second connecting means comprises a third profile bar providing first and second grooves therein, a fourth profile bar providing first and second grooves therein, a second plate with opposite end flanges that respectively extend in a second groove of said first profile bar and a first groove of said third profile bar, a third plate with opposite end flanges that respectively extend in a second groove of said third profile bar and a first groove of said fourth profile bar, and a fourth plate with end flanges that respectively extend in a second groove of said fourth profile bar and a second groove of said second profile bar, resulting in said scaffolding mast having a rectangular cross section.

7. A scaffolding mast according to claim 6, wherein said opposite end flanges of said second plate, said opposite end flanges of said third plate and said opposite end flanges of said fourth plate extend at about a 90° angle relative to respective center portions of said plates.

8. A scaffolding mast according to claim 1, wherein said first and second profile bars are made of aluminum.

9. A scaffolding mast according to claim 1, wherein said opposite end flanges of said first plate are permanently connected to said first and second profile bars.

10. A scaffolding mast according to claim 1, wherein said first and second profile bars define facing slideways, and including a self-propelled platform extending between said slideways and movable therealong.

* * * * *